US008181586B1

(12) United States Patent
Roumell

(10) Patent No.: US 8,181,586 B1
(45) Date of Patent: May 22, 2012

(54) PONTOON REST

(76) Inventor: Charles Roumell, Brooklyn, MI (US)

( * ) Notice: Subject to any disclaimer, the term of this patent is extended or adjusted under 35 U.S.C. 154(b) by 1068 days.

(21) Appl. No.: 11/702,732

(22) Filed: Feb. 6, 2007

(51) Int. Cl.
*B63C 7/00* (2006.01)

(52) U.S. Cl. ..... 114/44; 114/292

(58) Field of Classification Search ..... 114/44, 114/45, 259, 292, 369, 381
See application file for complete search history.

(56) References Cited

U.S. PATENT DOCUMENTS

| | | | | |
|---|---|---|---|---|
| 756,661 | A * | 4/1904 | Lemm | 114/381 |
| 850,239 | A * | 4/1907 | Martin | 114/369 |
| 898,094 | A * | 9/1908 | Clayton | 114/381 |
| 1,068,276 | A * | 7/1913 | Rogers | 114/381 |
| 1,300,954 | A * | 4/1919 | Gray | 114/45 |
| 4,895,096 | A * | 1/1990 | Goodwin et al. | 114/381 |
| 5,483,912 | A | 1/1996 | Thomas | |
| 5,884,885 | A | 3/1999 | Schmidt | |
| 6,321,678 | B1 | 11/2001 | Skulnick | |
| 6,422,167 | B1 * | 7/2002 | Bridges | 114/44 |
| 6,513,260 | B2 | 2/2003 | Krajec | |

* cited by examiner

*Primary Examiner* — Lars A Olson
(74) *Attorney, Agent, or Firm* — Robert L. McKellar; McKellar IP Law, PLLC

(57) ABSTRACT

The instant device is a device that when used in a plurality they will support a dry docked pontoon effectively and efficiently. The device has to be used in combination with at least three others to effectively support a dry docked pontoon. The device is manufactured with a grooved top surface allowing the v shaped groove of the bottom of a pontoon to rest within it and thereby preventing damage to the pontoon.

7 Claims, 3 Drawing Sheets

PONTOON REST

BACKGROUND OF THE INVENTION

In the marina business the storage of boats occurs for many reasons including seasonal weather requirements, repairs and limited docking facilities. Within these parameters different systems and methods are employed to deal with the dry docking requirements such as the instant device which incorporates a four walled device that has a base and an arcuate surface to interface with the bottom of a pontoon of a pontoon boat. This device is light weight, portable and stackable. It exceeds other devices because of its flexibility during use and non use.

In U.S. Pat. No. 6,513,260 issued to Krajec Feb. 4, 2003 discloses a device that is a nesting plate customizable to securely position a device within it. The device is adjustable and customizable in many embodiments; however Krajec is not stackable and is presumed to be a cradle for small electronic devices.

In U.S. Pat. No. 5,884,885 issued to Schmidt Mar. 23, 1999 discloses a cradle assembly for the dry docking of a water vehicle to the back of a large watercraft. The device consist of an upper and lower cradle assembly that when combined form a dry dock or cradle device designed to hold a watercraft. Again here the device is neither portable nor stackable.

In U.S. Pat. No. 5,483,912 issued to Thomas Jan. 16, 1996 discloses a small craft carrier that is designed to dry dock a smaller device to a large device much the same as Schmidt. However, Thomas includes a tilting platform to launch and retrieve the smaller water craft. The basic design is a v shaped block for resting the craft on. The instant invention uses a generally u shaped device that incorporates a generally v shaped area in its arcuate (or u shaped) area in concert with at least three others devices and again the device is portable and can be stacked one upon another when not in use.

In U.S. Pat. No. 6,321,678 issued to Skulnick Nov. 27, 2001 discloses an inflatable dingy chock. The general purpose of the inflatable dingy chock is to securely mount a dingy to a deck or platform. The device in Skulnick is designed for a dingy specifically; the instant invention is designed to be used specifically for pontoons and is designed to fit a pontoon and its protrusion of the pontoon at its bottom surface. The device in Skulnick is somewhat portable but it is not stackable. It also offers inflatibility as an easy storage means where the stackability of the instant invention creates a more effective storage capability because the device does not have to be re-inflated for another use, saving time and energy.

THE INVENTION

What is thus disclose and claimed herein is a device for supporting a dry docked pontoon comprising in combination; a base, four sides, a top having an arcuate top surface and a midpoint. The arcuate top surface has a linear axis, wherein there is a groove in the top surface along the linear axis near the midpoint. The base supports the four sides and the base and four sides are an integral unit.

Thus, this device is for supporting a dry docked pontoon. The sides ultimately terminate in a top surface that is an arcuate configuration with a linear axis. This arcuate configuration has a groove essentially centered within the arcuate top surface and along the linear axis for the intended purpose of supporting a pontoon of a pontoon boat.

DETAILED DESCRIPTION OF THE DRAWINGS

Figure 1:
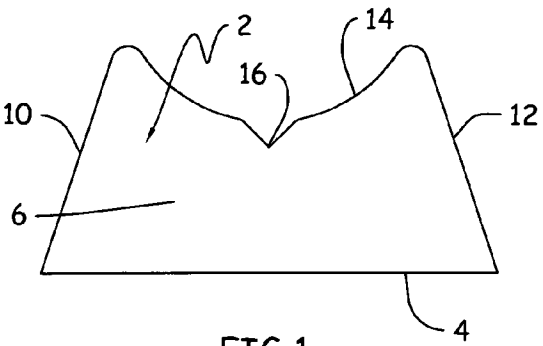
FIG. 1 is a front view of the device of this invention emphasizing the center groove of the arcuate surface.

FIG. 1 is a front view of a device of this invention (pontoon rest) 2 emphasizing the center groove 16 of the arcuate surface 14. The pontoon rest 2 consists of a base 4 that supports four side wall members. The front wall member 6 and a back wall member 8 are conjoined with a first side wall 10 and a second side wall 12 and terminate into the arcuate top to form arcuate top surface 14. The arcuate top surface 14 that is supported by the wall members 6,8,10 and 12 has a groove 16 centered along a linear axis A-A (FIG. 2) in the arcuate top surface 14. The purpose of the groove 16 is to facilitate the bottom rails or protrusions 22 of a pontoon of a pontoon boat. The groove 16 allows the protrusions 22 from the pontoon, to rest within its confines without damaging the bottom rail or protrusion 22. The arcuate surface 14 also facilitates the bottom of the pontoon 18. The pontoon boat 20 will rest on a set of four pontoon rests 2.

Figure 2:
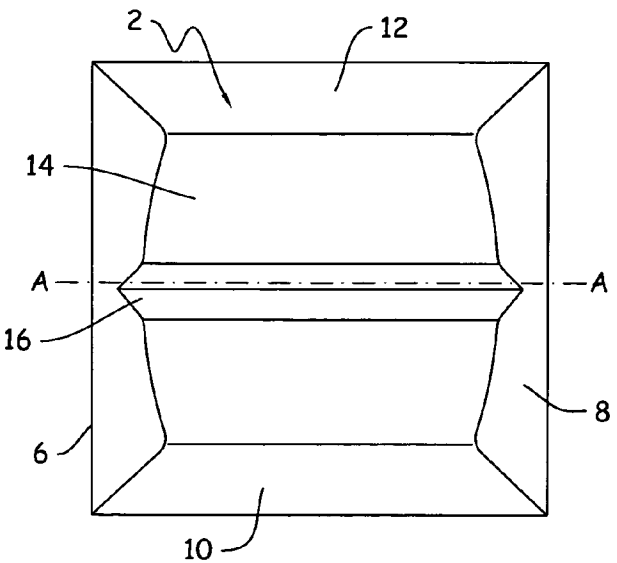
FIG. 2 is a top view of the device of FIG. 1.

FIG. 2 is a top view of the pontoon rest 2. This perspective clearly shows that the front wall 6, back wall 8, first side wall 10 and the second side wall 12 in their support for the arcuate top surface 14. Also shown is the groove 16 in the arcuate top surface 14.

Figure 3:
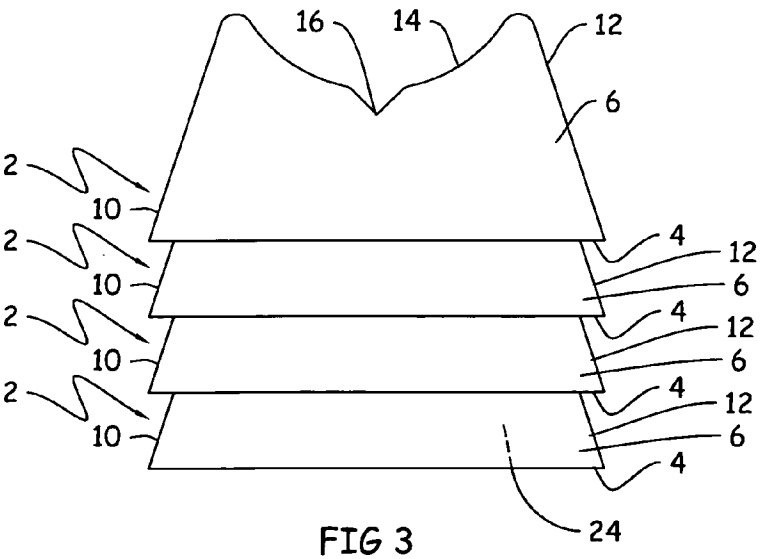
FIG. 3 is a compilation of four devices stacked one upon another showing their utility for storage.

FIG. 3 is a compilation of four pontoon rest 2 stacked one upon another showing their utility. The utility shown includes stackability and space savings. Each of the pontoon rests 2 will set one on top of another within the inside surface 24 of each rest 2. The inside surface 24 will be in contact with the base 4, front wall 6, back wall 8, first side wall 10 and second side wall 12. Because the pontoon rests 2 are all manufactured in the same manner such that they are uniform and they will stack symmetrically with the arcuate top surface 14 and its groove 16 of the top pontoon rest 2 exposed.

Figure 4:
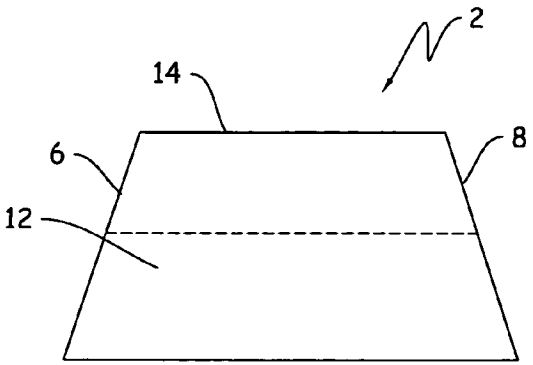
FIG. 4 is a side view of the device of FIG. 1.

FIG. 4 is a side view of the pontoon rest 2. This Figure shows the second side wall 12, the front wall 6 and the back wall 8. The arcuate top surface 14 is also shown.

Figure 5:
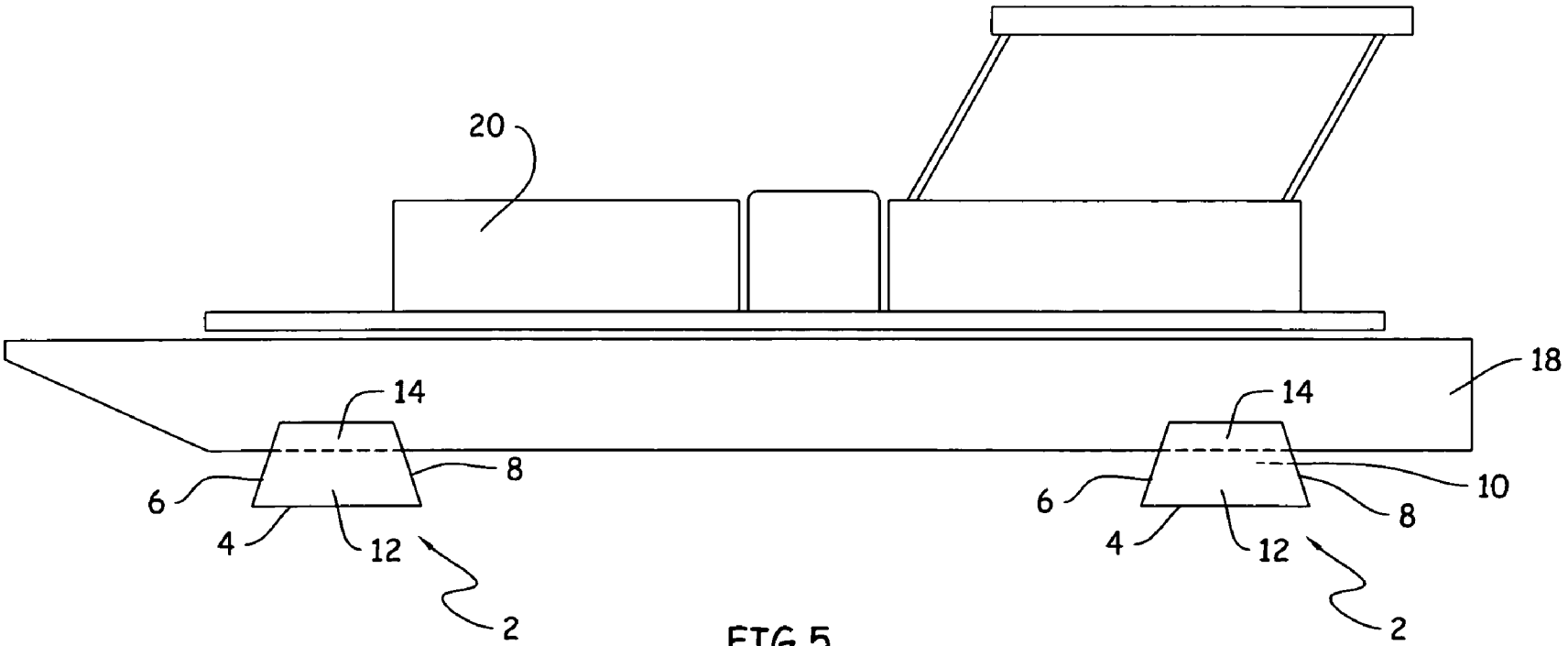
FIG. 5 is a side view of pontoon resting on a set of devices of this invention with only two of the devices visible.

FIG. 5 is a side view of a pontoon boat 20 resting on a set of four pontoon rests 2 with only two of the pontoon rests 2 visible. This Figure clearly shows how a set of the rests 2 support a single pontoon 18 of the pontoon boat 20. The pontoon 18 rests within the arcuate surface 14 of the rest 2. The rest 2 is placed on a supporting surface such as the ground or concrete against its base 4. The front wall 6 and the back wall 8 rise from the base 4 as well as the first side wall 10 and the second side wall 12.

Figure 6:
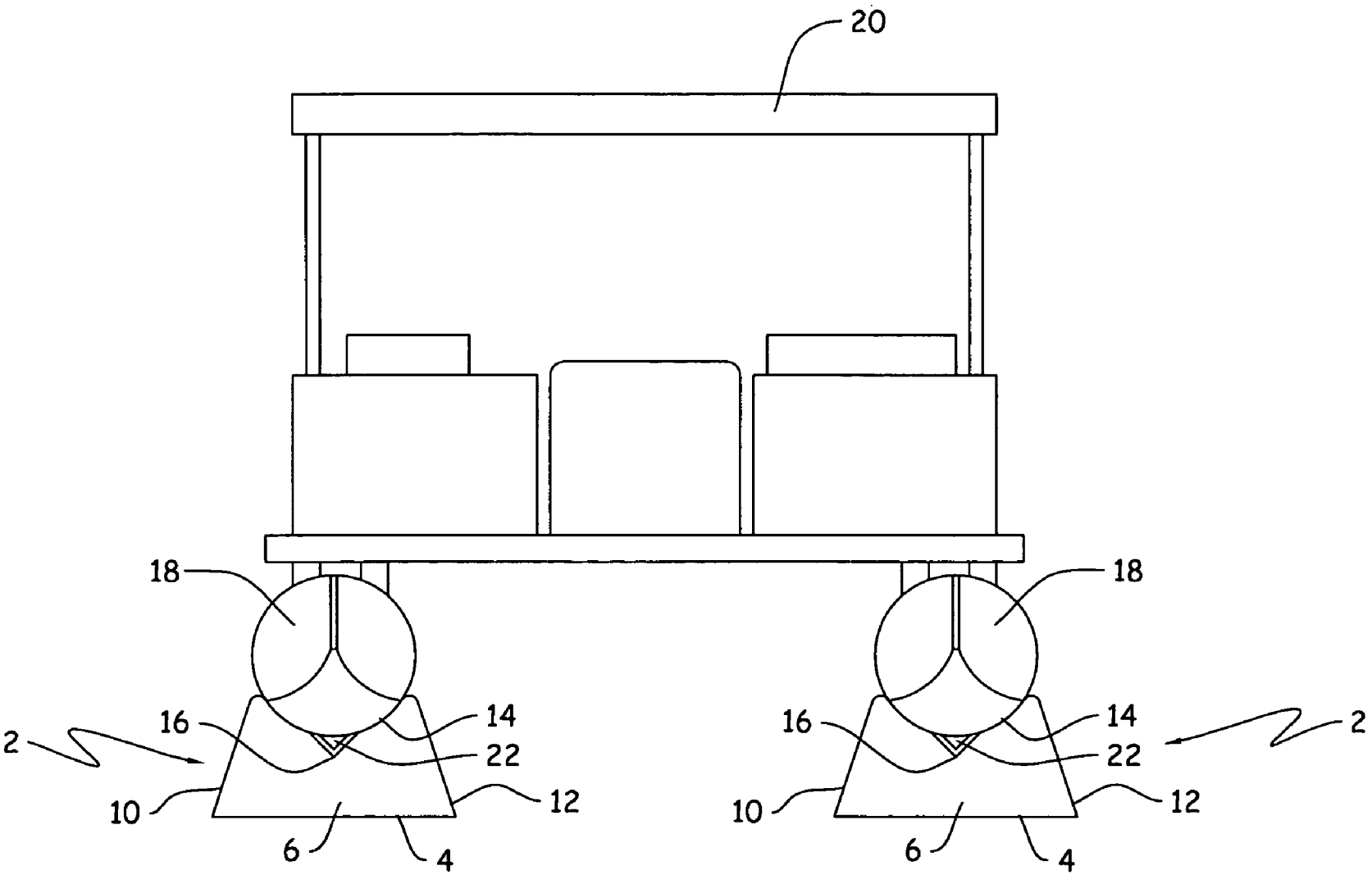
FIG. 6 is a front view of a pontoon boat resting on a set of four of the devices of this invention with only two such devices visible.

FIG. 6 is a front view of a pontoon boat 20 resting on a set of four pontoon rests 2 with only two showing. The Figure clearly shows how the pontoons 18 of the pontoon boat 20 securely rest within the arcuate top surface 14 of the rest 2. With a set of four rests 2 a pontoon boat 20 can be repaired or stored in a dry dock position virtually anywhere. The portability and stackability of the rests 2 is what clearly makes this device unique over all other pontoon resting devices and dry dock apparatii. This Figure shows the utility of the instant device. The rest 2 consists of a base 4 with four sides rising from the base 4, the front side 6, the back side 8, the first side wall 10 and the second side wall 12 converging to form the arcuate top surface 14 then terminating into a groove 16 that supports the protrusion 22 for the bottom of the pontoon 18.

The portability and the stackability of the instant device is what sets it apart from the prior art. They can be used on a multitude of surfaces and stacked when they are not in use eliminating the storage required by other forms of dry docking devices.

One main objective of the pontoon rest is to provide support to pontoons of a pontoon boat during storage or repair. It is essential that the method of storage be inexpensive, portable and flexible. When the device is manufactured in large quantities from plastic it can be produced inexpensively and still maintain a high quality standard. Because the device is made primarily of light weight material it is highly portable. Further, the rests capability to stack one upon another gives it greater efficiency and flexibility.

One of the major advantages of this device is that it is stackable. The device can be manufactured from any one of a group of materials consisting of plastic, metal, rubber, wood, composite plastics, cardboard, fiberboard, masonry and graphite. It can be manufactured from any other suitable material. The rests are used as a support in the manufacture of single pontoons as a rest. During the manufacture of a pontoon boat the individual pontoons are manufactured separately from one another until they are connected to the boat frame. Prior to that time the rest is used to manufacture and store individual pontoons.

The pontoon rest 2 can be manufactured by an injection molding process. It can also be manufactured by other standard molding processes. This device can also be manufactured by casting. The device can be manufactured from molded plastic. The device is also be manufactured from aluminum.

What is claimed is:

1. A device for supporting a dry docked pontoon comprising in combination: a base, four sides, a top having an arcuate top surface and a midpoint;

said arcuate top surface having a linear axis, wherein there is a groove in said top surface along the linear axis near the midpoint;

said base supporting the four sides and said base and four sides being an integral unit, wherein the device is stackable within another said device.

2. A device as claimed in claim 1 wherein the device is manufactured from a material selected from the group consisting of plastic, metal, rubber, wood, composite plastics, cardboard, fiberboard, masonry and graphite.

3. A device as claimed in claim 1 wherein said device is manufactured using standard molding processes.

4. A device as claimed in claim 3 wherein said device is manufactured by injection molding.

5. A device as claimed in claim 3 wherein said device is manufactured by casting.

6. A device as claimed in claim 1 wherein said device is manufactured from plastic.

7. A device as claimed in claim 1 wherein said device is manufactured from aluminum.

* * * * *